United States Patent [19]

Showman et al.

[11] 4,392,700

[45] Jul. 12, 1983

[54] CAM ACTUATED ZERO INSERTION FORCE MOTHER/DAUGHTER BOARD CONNECTOR

[75] Inventors: Robert L. Showman, Hershey; Robert N. Weber, Hummelstown, both of Pa.

[73] Assignee: AMP Incorporated, Harrisburg, Pa.

[21] Appl. No.: 300,332

[22] Filed: Sep. 8, 1981

[51] Int. Cl.[3] ..... H01R 13/629

[52] U.S. Cl. ..... 339/17 M; 339/75 MP; 339/176 MP

[58] Field of Search ..... 339/17 M, 75 MP, 74 R, 339/176 MP

[56] References Cited

U.S. PATENT DOCUMENTS

| | | | |
|---|---|---|---|
| 3,397,381 | 8/1968 | Gilissen | 339/176 |
| 3,533,045 | 10/1970 | Henschen | 339/17 |
| 3,651,444 | 3/1972 | Desso et al. | 339/42 |
| 3,899,234 | 8/1975 | Yeager et al. | 339/74 R |
| 3,982,807 | 9/1976 | Anhalt et al. | 339/176 MP |

FOREIGN PATENT DOCUMENTS

| | | | |
|---|---|---|---|
| 2252670 | 6/1975 | France | 339/75 MP |
| 885040 | 12/1961 | United Kingdom | 339/75 MP |

*Primary Examiner*—John McQuade
*Attorney, Agent, or Firm*—Russell J. Egan

[57] ABSTRACT

A zero insertion force connector is disclosed for making an interconnection between a mother circuit board and a daughter circuit board. A receptacle assembly is mounted on the mother board and includes a housing with a carrier block movably mounted therein. A plurality of first terminals are fixed in the housing and a plurality of second terminals are fixed in the carrier block making a constant wiping engagement with the first terminals. In a two-piece embodiment a plug assembly is mounted on the daughter board and is receivable in the cavity of the receptacle assembly. A plurality of third terminals are mounted on the plug assembly and make a fixed engagement with the daughter board and are positioned to make a wiping engagement with the second terminals in the carrier block after the plug assembly is received in the receptacle assembly and the carrier block is moved relative thereto. In a one-piece or edge board embodiment, the second terminals have folded beams which, when raised by the carrier block, engage the receptacle housing to be cammed into wiping contact with the daughter board.

13 Claims, 8 Drawing Figures

14

90
90
18
78
84
76
86
80
88
82
28
38
42
44
40
60
58
56
50
58
46
24
26
52
60
54
72
48
62
66
68
34
34
30
32
22
32
12
36
29

110
148
116
144
146
102
140
122
134
126
130
142
108
106
104
112
154
120
100
94
114
132
124
136
128
98
96

94
118
114
148
116
144
146
138
154
110
112
102
140
142
120
100
106
122
126
134
130
108
104
132
124
128
136
98
96

CAM ACTUATED ZERO INSERTION FORCE MOTHER/DAUGHTER BOARD CONNECTOR

The present invention relates to a mother/daughter board connector and in particular to a cam actuated connector having zero insertion force and available in either edge board or two-piece embodiments.

There are generally two types of connector systems that are used for making an electrical interconnect between mother circuit boards and daughter circuit boards. One would be a straight edge board connector, such as that disclosed in U.S. Pat. Nos. 3,397,381 and 3,533,045. This would generally be referred to as a one-piece connector since there is nothing added to the daughter circuit board which is required to effect the interconnection. The second type of interconnection system would be a two-piece connection system such as disclosed in U.S. Pat. No. 3,651,444. In a two-piece system there is a component of the connector which is permanently secured to the daughter board and absorbs most of the wear accompanying mating and unmating of the connector. A third type of interconnection system would be a subdivision of either of the foregoing types in that it would have means included for effecting a zero insertion force mating of either a straight edge or a two-piece connector system. The present invention is of this latter type.

The present invention concerns an interconnection system for making a zero insertion force interconnection between a mother circuit board and a daughter circuit board. One embodiment of the subject connector system has only a receptacle assembly which is secured to the mother board while another embodiment includes a plug assembly which is secured to the daughter board and received in the receptacle assembly. The receptacle assembly includes a housing having a daughter board receiving cavity, a plurality of first terminals fixedly mounted in the first cavity, a carrier block having a plurality of second terminals mounted therein in an array each having one end in constant slidingly engagement with the first terminals and the opposite end adapted to engage the daughter board, and camming means for moving the carrier block normal to the base of the cavity. The plug assembly of the alternate embodiment has a plurality of third terminals mounted in a housing which has one end profiled to be received in the cavity and the opposite end profiled to engage the daughter circuit board. Each of the third terminals in the plug assembly have a portion profiled to slidably engage the second terminals of the carrier block. The plug assembly also includes means to engage and guide the carrier block.

Embodiments of the subject invention will now be described by way of example with reference to the accompanying drawings, in which.

Figure 1:
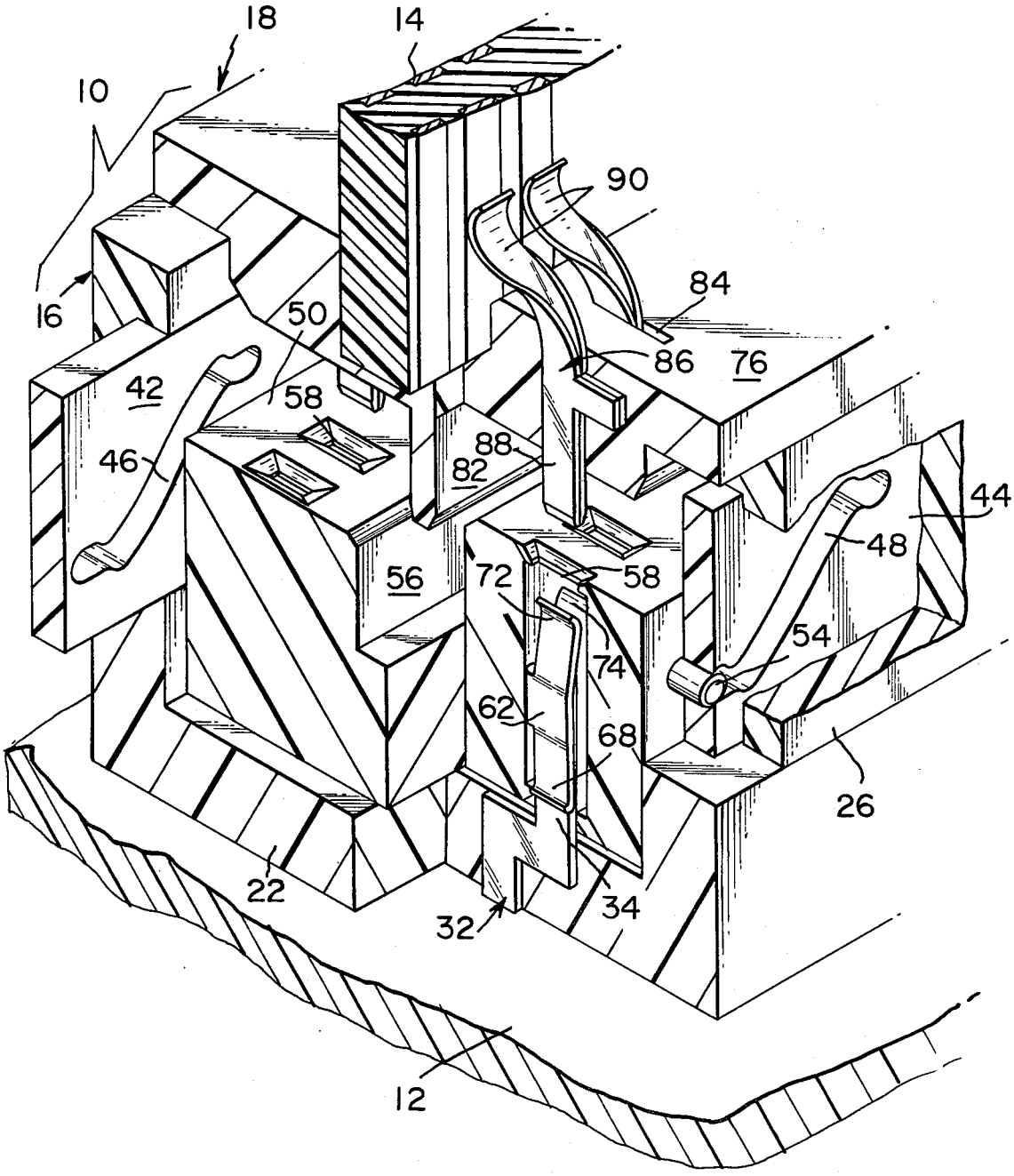
FIG. 1 is a perspective view, partially in section and partially broken away, through a connector according to the present invention in an unmated condition.

The present invention is a connector system 10 for electrically interconnecting a mother board 12 to a daughter board 14. One embodiment of the subject system 10 has a receptacle assembly 16, which is mounted on the mother board 12, and a plug assembly 18, which is mounted on an edge portion of the daughter board 14.

Figure 3:
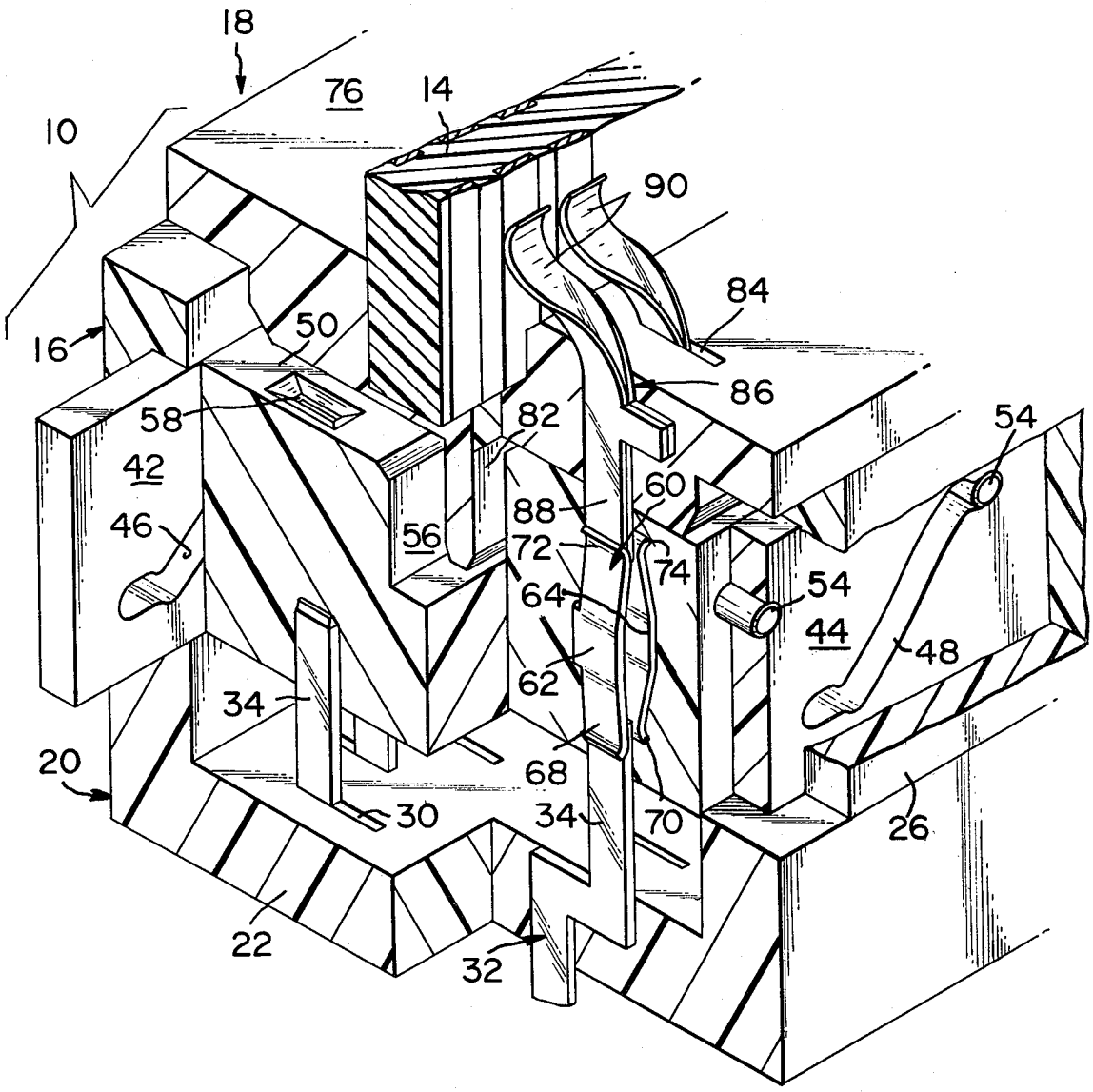
FIG. 3 is a perspective view, partially in section and partially broken away as in FIG. 1, showing the subject connector in the fully mated condition.
Figure 4:
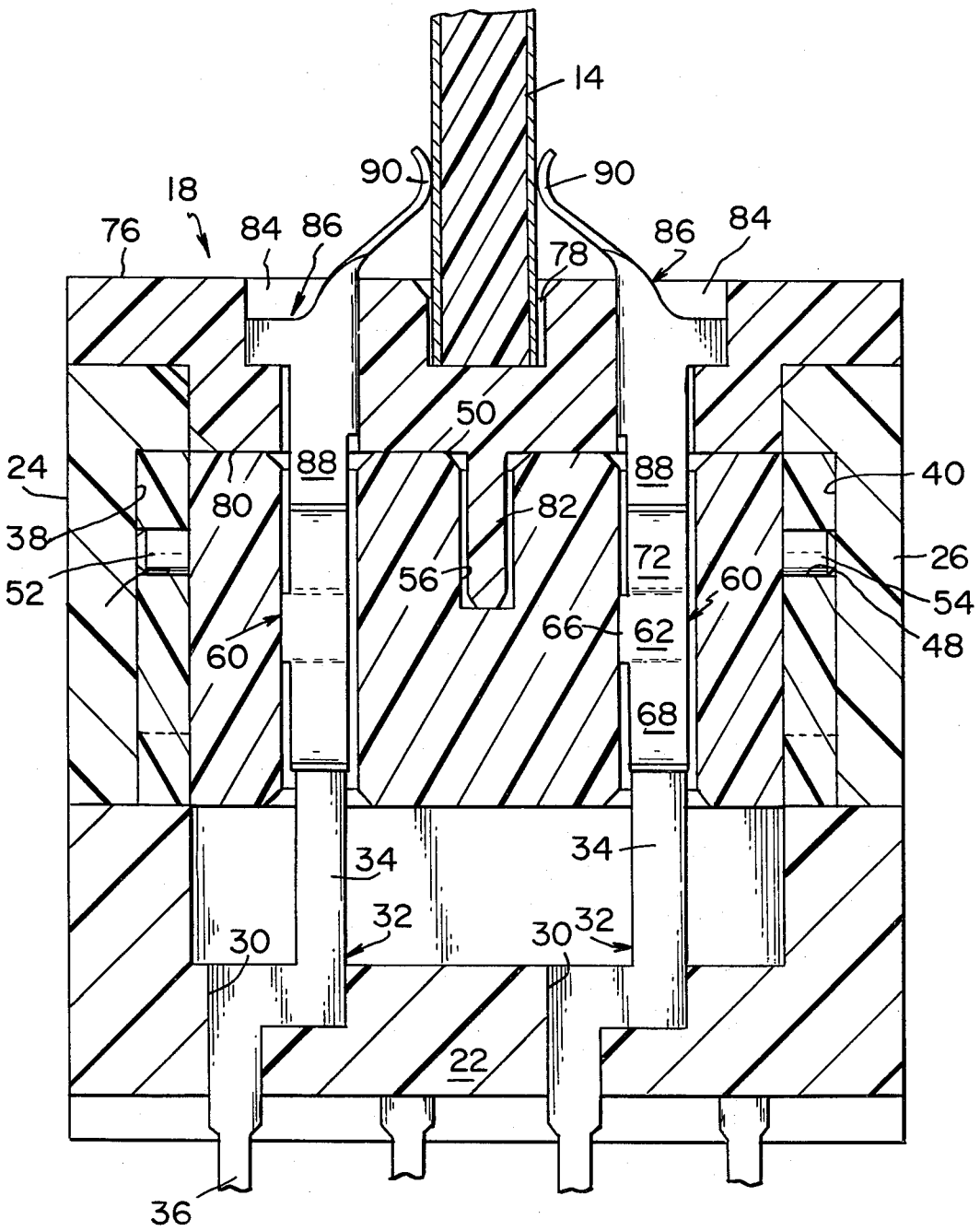
FIG. 4 is a transverse section similar to FIG. 2 showing the subject connector in the mated condition of FIG. 3.

The receptacle assembly 16 includes an elongated housing 20 of rigid insulative material having a base 22 and a pair of spaced side walls 24, 26 defining an elongated cavity 28. The base 22 has a plurality of terminal apertures 30 therein in a spaced array. A first terminal 32 is mounted in each aperture having a blade portion 34 extending into the cavity 28 and a pin portion 36 extending through the base 22 to engage with an appropriate conductive aperture 29 of the mother board 12. Each side wall 24, 26 has an inwardly directed recess 38, 40 each of which receives a respective cam member 42, 44. Each cam has a respective cam track 46, 48. A carrier block 50 is received in the cavity 28 and has outwardly directed cam follower pins 52, 54 engaging in the respective tracks 46, 48. The cam tracks 46, 48 provide reciprocating movement of the carrier block 50 in the cavity 28 with a slight return movement at the end of each stroke. The carrier block 50 also has an elongated guide recess 56 and a plurality of terminal passages 58 each containing a second terminal 60. Each second terminal 60 is formed with a pair of side walls 62, 64 (see FIGS. 1 and 3) connected by a bight 66 and forming a pair of first gripping arms 68, 70 which grip and slide in constant engagement along the blade 34 of the respective first terminal 32 and oppositely directed pair of second gripping arms 72, 74.

The plug portion 18 is an elongated member of rigid plastics material having an upper surface 76 with a central daughter circuit board receiving recess 78. The lower surface 80 of the plug portion 18 is profiled to be received in the cavity 28 of the receptacle assembly 16 and has a centrally disposed guide projection 82 positioned to be aligned with the guide recess 56 of the carrier block 50. A plurality of terminal passages 84 extend between the surfaces 76, 80 in a spaced array and a like plurality of third terminals 86 are positioned in each respective passage. Each third terminal 86 has a depending blade portion 88 aligned to slidably engage in the gripping arms 72, 74 of the second terminals 60 in the carrier block 50 and a tail portion 90 for making fixed contact with the conductor of the daughter board 14. It should be noted that the tails 90 can either; make a resilient engagement with the daughter board 14, as shown, or be permanently secured thereto by any known means such as solder (not shown).

Figure 5:
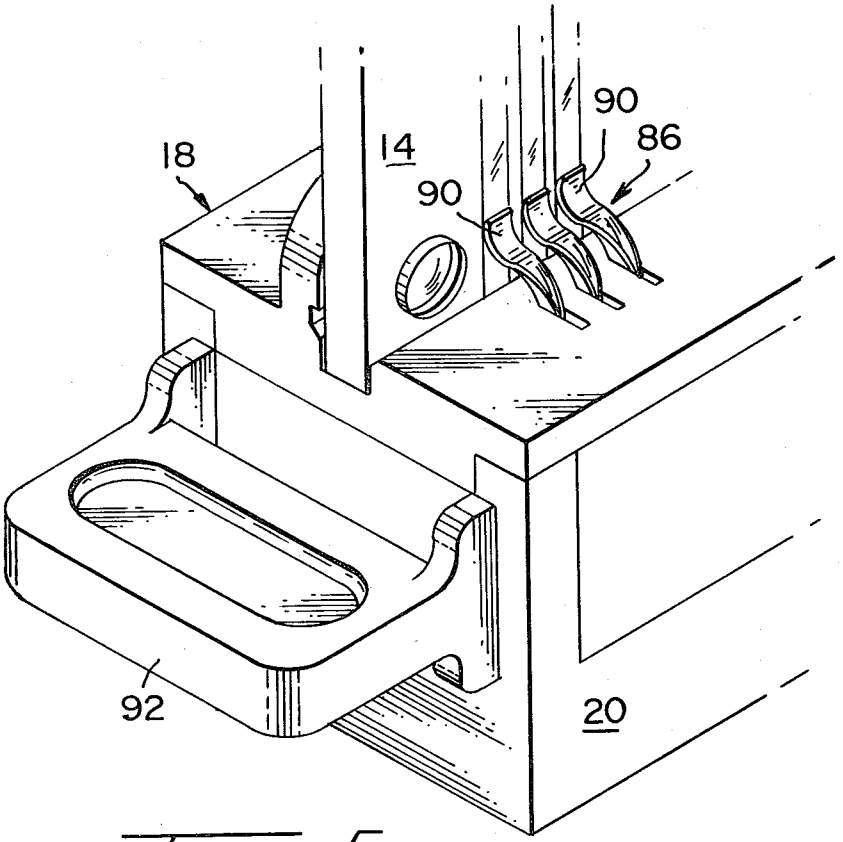
FIG. 5 is a perspective view of one end of the subject connector in a mated condition.

The cam members 42, 44 are preferably joined at one end for actuation by a handlle 92 which lies outside the receptacle housing 20, as shown in FIG. 5.

Figure 2:
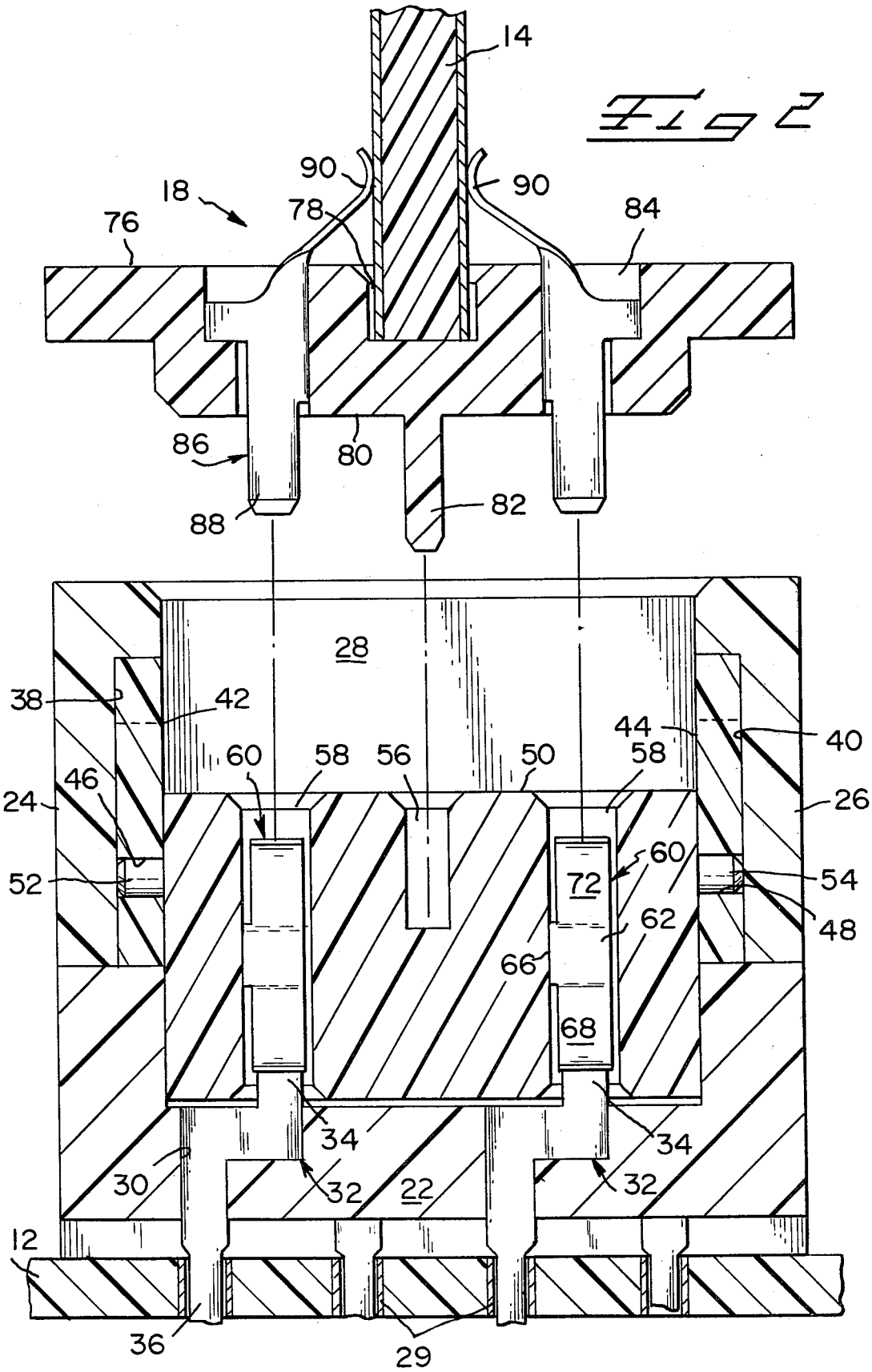
FIG. 2 is a transverse section through the connector of the present invention in the unmated condition of FIG. 1.

In operation this embodiment of the subject invention would have the respective receptacle assemblies 16 and plug assemblies 18 joined to the mother boards 12 and daughter boards 14 respectively in the usual fashion. In the case of the receptacle assembly 16, the pin portions 36 of the first terminals 32 would be secured to the conductive holes 29 of the mother board 12. This would be adequate for holding the receptacle assembly 16 in place although the housing 20 could be provided with additional hold-down means (not shown). The plug assembly 18 would also be joined to the daughter board 14 with the tails 90 being engaged with conductive pads of the daughter board 14 as previously mentioned. To make an interconnection, the daughter board 14 would be aligned with the receptacle assembly 16 on the mother board 12 as shown in FIGS. 1 and 2. The carrier 50 would initially be in the lower position in cavity 28 against base 22 with the second terminals 60 making a wiping engagement with the blades 34 of the first terminals 32. The plug assembly 18 would then be inserted into the cavity 28 of the receptacle assembly 16. In this position the guide projection 82 is immediately over the guide recess 56 of the carrier block 50 and the blades 88 of the third terminals 86 are aligned above the respective second gripping arms 72, 74 of the second terminals 60 will receive the blades 88 of the third terminals 86 therein while the first gripping arms 68, 70 make a continuous sliding contact with the blades 34 of the first terminals 32. Thus, the interconnection between the first and third terminals 32 to 86 will be effected.

Figure 7:
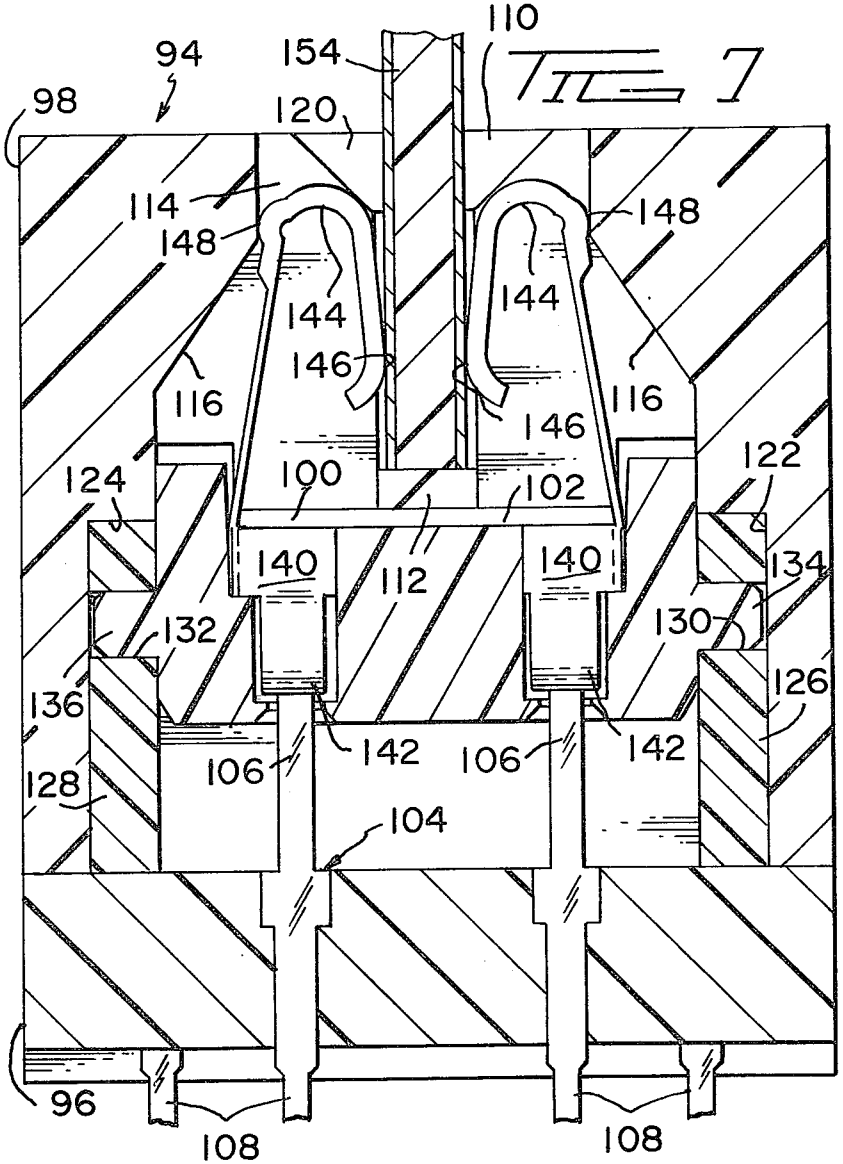
FIG. 7 is a transverse section similar to FIG. 6 showing the alternate embodiment in the mated condition.
Figure 6:
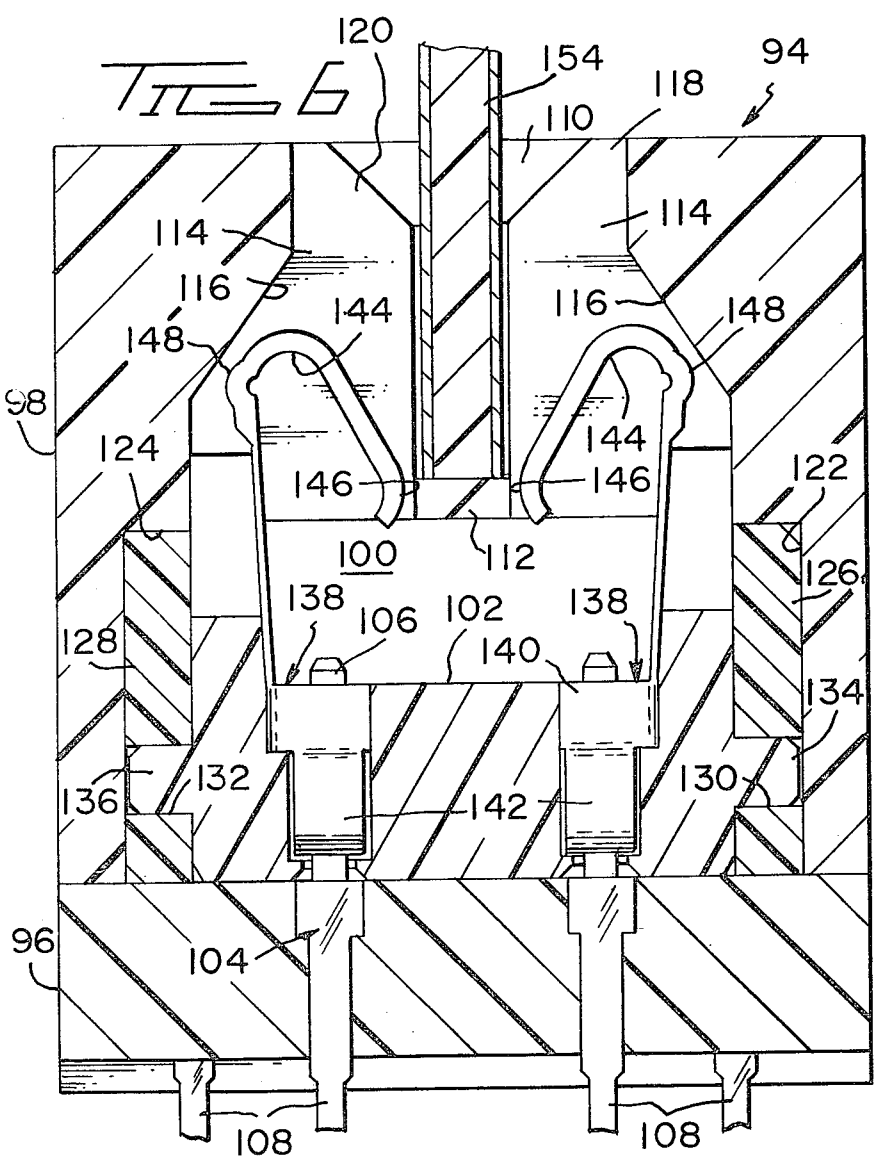
FIG. 6 is a transverse section similar to FIGS. 2 and 4 showing an alternate edge board connector embodiment of the subject invention in an unmated condition.
Figure 8:
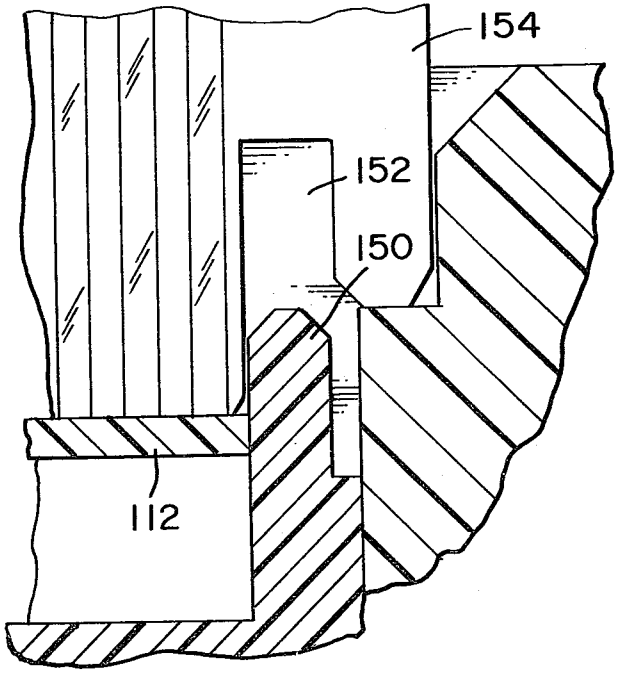
FIG. 8 is a longitudinal section through one end of the alternate embodiment of FIGS. 6 and 7.

The one-piece or edge board embodiment of the present invention is shown in FIGS. 6 to 8. This receptacle assembly 94 has a two-part housing formed by a base 96 and cover 98. Together the base 96 and cover 98 define a cavity 100 enclosing carrier block 102. The base 96 has a plurality of first terminals 104 mounted therein in a spaced array with each first terminal having a block portion 106 extending into the cavity 100 and pin portion 108 extending outwardly of the housing to be engaged in an appropriate conductive aperture (not shown) of a mother board (also not shown). The cover 98 has an elongated daughter board receiving recess 110 with a stop 112 spaced above base 96 and a plurality of terminal recesses 114 opening onto recess 110 from either side, each recess 114 having a cam surface 116. Partitions 118, 120 separate the adjacent recesses 114 to form a pair of comb-like profiles. The cover 98 also has a pair of oppositely spaced cam receiving recesses 122, 124. An elongated cam member 126, 128 is located in each respective recess 122, 124, each cam member having a respective cam track 130, 132 therein. The carrier block 102 has a pair of outwardly directed lugs 134, 136 each engaging in a respective cam track 130, 132. A plurality of second terminals 138 are mounted in the carrier block 102. Each second terminal has a body portion 140 with at least one arm 142 extending therefrom to be in constant wiping engagement with blade 106 of the respective first terminal 104. Preferably this can be a pair of arms similar to arms 68, 70 of the second terminals 60 described above in relation to the two-piece connector embodiment. The opposite end of each second terminal 138 has a beam 144 which is folded upon itself and has a board engaging nose 146 and an oppositely directed cover engaging protrusion 148.

FIG. 8 shows a keying arrangement which is formed by a projection 150 integral with one end of the carrier block 102 and a recess 152 in the daughter board 154. If the daughter board 154 is not properly located in the receptacle assembly 94, then the projection 150 will not be received in the recess 152. This would prevent the carrier block 102 from rising and the subsequent engagement of the second terminals 138 on the daughter board 154.

The operation of this embodiment is quite similar to the previously described two-piece connector embodiment. The daughter board 154 is inserted into groove 110 when the carrier block 102 is in the lower position, as shown in FIG. 6. The cam members 126, 128 are then actuated to move longitudinally. The lugs 134, 136 follow the respective cam tracks 130, 132 causing the carrier block 102 to move to the raised position shown in FIG. 7. During this movement the protrusions 148 of second terminals 138 engage the cam surfaces 116 to be driven inwardly so that nose portions 146 make a wiping engagement with the respective pads of the daughter board. The upward movement of the carrier block 102 will also bring projection 150 into recess 152 locking the daughter board against an edgewise withdrawal from the receptacle assembly 94.

We claim:

1. A zero insertion force connector assembly for mounting a daughter circuit board on a mother circuit board comprising:

a receptacle having a housing defining an elongated daughter board receiving cavity with a closed bottom, a carrier block movably mounted in said cavity, cam means mounted in said housing and adapted to move said carrier block with respect to the bottom of said cavity, a plurality of first terminals fixedly mounted in the bottom of said cavity, each said first terminal having a pin portion extending through the bottom and a blade portion extending into said cavity, a like plurality of second terminals mounted in said carrier block each having one end in constant wiping engagement with a respective blade portion of a respective first terminal, and an opposite second end adapted to make wiping engagement with a contact of said daughter board.

2. A zero insertion force connector assembly according to claim 1 wherein said housing comprises:

a substantially flat base; and a cover received on said base to define said cavity therewith.

3. A zero insertion force connector assembly according to claim 2 wherein said cover defines an elongated daughter board receiving groove with a board stop spaced above said base.

4. A zero insertion force connector assembly according to claim 2 wherein said cover defines cam surfaces engagable by said second terminals whereby movement of said carrier block towards said cam surfaces drives said second terminals into wiping engagement with said daughter board.

5. A zero insertion force connector assembly according to claim 1 wherein said cam means includes:

a cam track designed to bring said second terminals into full engagement with said daughter board and then back slightly off without breaking contact therebetween causing wiping of the mating surfaces.

6. A zero insertion force connector assembly according to claim 1 further comprising:

means external of said housing for actuating said cam means.

7. A zero insertion force connector assembly according to claim 1 further comprising:

means to mount said housing on said mother board.

8. A zero insertion force connector assembly according to claim 1 further comprising:

a plug member having a first surface profiled to receive an edge portion of said daughter board and oppositely directed second surface profiled to be receivable in said receptacle housing;

a like plurality of third terminals fixedly mounted in said plug member extending from both surfaces thereof, each said third terminal having a first portion extending from the first surface making permanent engagement with a conductor of said daughter board, and a blade portion extending from said second surface for making wiping engagement with said second terminal upon relative movement of said carrier block with respect to said daughter board.

9. A two-piece zero insertion force connector assembly for mounting a daughter circuit board on a mother circuit board comprising:

a receptacle having a housing defining an elongated daughter board receiving cavity with a bottom, a carrier block movably mounted in said cavity, cam means mounted in said housing and adapted to move said carrier block with respect to the bottom of said cavity, a plurality of first terminals mounted in the bottom of said cavity, each said first terminal having a pin portion extending through the bottom and a blade portion extending into said cavity, a like plurality of second terminals mounted in said carrier block each having a first end in wiping engagement with a respective blade portion of a respective first terminal and an oppositely directed second end of like configuration to said first end; and a plug member having a housing with a first surface profiled to receive said daughter board and an oppositely directed second surface profiled to be received in said cavity, a plurality of third terminals mounted in said plug member extending from the surfaces thereof, each said third terminal having a first portion extending from the first surface and making permanent engagement with a pad of said daughter board, and a blade portion extending from said second surface to engage a respective second end of a respective second terminal carried by said carrier block, whereby said daughter board is mated with said mother board with said carrier block in its lower position with only said first and said second terminals in engagement and upon activation of said cam means said carrier block is raised to engage said second and said third terminals without breaking contact between said first and said second terminals.

10. A two-piece zero insertion force connector assembly for making mother/daughter board interconnection comprising:

a receptacle assembly profiled to be mounted on said mother board, said receptacle assembly having an elongated housing with a top and a bottom, said top defining an elongated cavity, a carrier block mounted in said cavity for movement normal to said bottom, a plurality of contact passages in a patterned array in said bottom and in said carrier block with said passages being in substantial alignment, a like plurality of first terminals fixedly mounted in said bottom, each said first terminal having a blade portion extending into said cavity and a pin portion extending through said bottom to engage said mother circuit circuit board, a like plurality of second terminals each in a respective one of said passages of said carrier block and having a first end making continuous wiping engagement with a respective blade portion of a respective first terminal, cam means for moving said carrier block with respect to said bottom; and a plug assembly mounted on said daughter board, said plug assembly having a housing with a first surface profiled to receive said daughter board therein and an oppositely directed second surface profiled to be received in said cavity of said receptacle assembly, a like plurality of third terminals each fixedly mounted in said plug housing with first and second portions extending beyond said first and said second surfaces respectively, said first end portions engaging conductors of said daughter board and said second ends profiled to make wiping engagement with said second terminals of said carrier block, whereby said plug assembly is mated into said receptacle assembly with said carrier block in a lower position with the first and second terminals in engagement and the second and third terminals out of engagement, and subsequent actuation of said cam means raises the carrier block to bring the second terminals into wiping engagement with the third terminals without breaking contact with said first terminals.

11. A two-piece connector assembly according to claim 10 wherein each said second terminal has at least one end formed by a pair of closely spaced arms profiled to receive therebetween a blade portion of a mating terminal.

12. A two-piece connector assembly according to claim 10 further comprising:

guide means on said plug assembly to assure aligned movement of said carrier block with respect to said receptacle and said plug assemblies.

13. A two-piece connector assembly according to claim 10 further comprising:

means on said carrier block preventing movement thereof when said plug assembly is not properly aligned in said cavity.

* * * * *